US007527096B2

(12) United States Patent
Chung et al.

(10) Patent No.: US 7,527,096 B2
(45) Date of Patent: May 5, 2009

(54) METHODS OF IMPROVING HEAVY OIL PRODUCTION

(75) Inventors: Bernard Compton Chung, Calgary (CA); Mintu Bose, Calgary (CA); Stewart Allan Morton, Calgary (CA); Kenneth James Elkow, Calgary (CA); Ed Erlendson, Calgary (CA)

(73) Assignee: Nexen Inc., Calgary (CA)

( * ) Notice: Subject to any disclaimer, the term of this patent is extended or adjusted under 35 U.S.C. 154(b) by 323 days.

(21) Appl. No.: 11/049,294

(22) Filed: Feb. 3, 2005

(65) Prior Publication Data

US 2006/0162922 A1 Jul. 27, 2006

(30) Foreign Application Priority Data

Dec. 26, 2004 (CA) ..... 2494391

(51) Int. Cl.
*E21B 43/17* (2006.01)
*E21B 43/24* (2006.01)

(52) U.S. Cl. ..... 166/268; 166/263; 166/272.3

(58) Field of Classification Search ..... 166/245, 166/50, 263, 268, 272.3, 303
See application file for complete search history.

(56) References Cited

U.S. PATENT DOCUMENTS

| | | | |
|---|---|---|---|
| 1,342,781 | A | 6/1920 | Vedder |
| 2,137,167 | A | 11/1938 | Lang |
| 2,923,356 | A | 2/1960 | Glass et al. |
| 3,179,166 | A | 4/1965 | Sharp |
| 3,301,326 | A | 1/1967 | McNamer |
| 3,559,737 | A | 2/1971 | Ralstin |
| 3,794,114 | A | 2/1974 | Brandon |
| 3,989,108 | A | 11/1976 | Allen |
| 4,026,358 | A | 5/1977 | Allen |
| 4,099,568 | A | 7/1978 | Allen |
| 4,324,291 | A | 4/1982 | Wong et al. |
| 4,509,596 | A | 4/1985 | Emery |
| 4,610,304 | A | 9/1986 | Doscher |
| 4,682,652 | A | 7/1987 | Huang et al. |
| 4,700,779 | A | 10/1987 | Huang et al. |
| 4,718,485 | A | 1/1988 | Brown et al. |
| 4,785,882 | A | 11/1988 | Sprunt |

(Continued)

FOREIGN PATENT DOCUMENTS

CA 1015656 8/1977

(Continued)

OTHER PUBLICATIONS

Sawatzky, Ron, "In Situ Recovery methods for Heavy Oil and Bitumen", presented at the 2004 CSEG National Convention, Edmonton, Canada.

(Continued)

*Primary Examiner*—Jennifer H Gay
*Assistant Examiner*—Daniel P Stephenson
(74) *Attorney, Agent, or Firm*—Santosh K. Chari; Blake, Cassels & Graydon LLP

(57) ABSTRACT

The invention provides an improved method for producing heavy oil or bitumen in a reservoir. The invention involves directing the formation of a solvent fluid chamber through the combination of directed solvent fluid injection and production at combinations of horizontal and/or vertical injection wells so as to increase the recovery of heavy oil or bitumen in a reservoir.

30 Claims, 9 Drawing Sheets

U.S. PATENT DOCUMENTS

| | | | | |
|---|---|---|---|---|
| 4,794,987 | A | 1/1989 | Kokolis et al. | |
| 4,832,122 | A | 5/1989 | Corey et al. | |
| 4,834,179 | A | 5/1989 | Kokolis et al. | |
| 4,850,429 | A | 7/1989 | Mims et al. | |
| 5,060,730 | A | 10/1991 | Kisman et al. | |
| 5,062,483 | A | 11/1991 | Kisman et al. | |
| 5,065,821 | A | 11/1991 | Huang et al. | |
| 5,244,041 | A | 9/1993 | Renard et al. | |
| 5,273,111 | A | 12/1993 | Brannan et al. | |
| 5,407,009 | A | 4/1995 | Butler et al. | |
| 5,607,016 | A | 3/1997 | Butler | |
| 5,860,475 | A | 1/1999 | Ejiogu et al. | |
| 5,899,274 | A | 5/1999 | Frauenfeld et al. | |
| 6,016,873 | A * | 1/2000 | Hsu et al. | 166/402 |
| 6,095,344 | A | 8/2000 | White | |
| 6,119,776 | A | 9/2000 | Graham et al. | |
| 6,257,334 | B1 * | 7/2001 | Cyr et al. | 168/272.7 |
| 6,318,464 | B1 | 11/2001 | Mokrys | |
| 6,318,465 | B1 | 11/2001 | Coon et al. | |
| 6,474,413 | B1 | 11/2002 | Barbosa et al. | |
| 6,619,396 | B1 | 9/2003 | Kimoto et al. | |
| 6,662,872 | B2 | 12/2003 | Gutek et al. | |

FOREIGN PATENT DOCUMENTS

| | | |
|---|---|---|
| CA | 1018058 | 9/1977 |
| CA | 1059432 | 7/1979 |
| CA | 1239088 | 7/1988 |
| CA | 2015460 | 12/1993 |
| CA | 2018952 | 11/1994 |
| CA | 2015459 | 8/1995 |
| CA | 2018951 | 3/1996 |
| CA | 2108349 | 8/1996 |

OTHER PUBLICATIONS

Squires, Andrew. "Inter-well Tracer Results and Gel Blocking Program", presented at the Tenth Annual Clearwater Reservoir, Elk Point, Alberta, Canada Mar. 9, 1993.

Butler, R. M.; Jiang, Q "Improved Recovery of Heavy Oil by Vapex with Widely Spaced Horizontal Injectors and Producers" *Journal of Canadian Petroleum Technology*, Jan. 2000, vol. 39, No. 1.

Butler, R. M. ; Mokrys, I. J., "Recovery of Heavy Oils Using Vaporized Hydrocarbon Solvents: Further Development of the Vapex Process", *Journal of Canadian Petroleum Technology*, Jun. 1993, vol. 32, No. 6.

Morkey, Igor J.; Butler, Roger M., The Rise of Interfering Solvent Analog Model of Steam-Assisted Gravity Drainage, *Journal of Canadian Petroleum Technology*, Mar. 1993, vol. 32, No. 3.

Butler, R. M. ; Mokrys, I. J., "Closed-loop Extraction Method for the Recovery of Heavy Oils and Bitumens Underlain by Aquifers: the Vapex Process", *Journal of Canadian Petroleum Technology*, Apr. 1998, vol. 37, No. 4.

* cited by examiner

METHODS OF IMPROVING HEAVY OIL PRODUCTION

FIELD OF THE INVENTION

The present invention is directed to oil extraction processes used in the recovery of hydrocarbons from hydrocarbon deposits.

BACKGROUND OF THE INVENTION

There exist throughout the world deposits or reservoirs of heavy oils and bitumen which, until recently, have been ignored as sources of petroleum products since the contents thereof were not recoverable using previously known production techniques. While those deposits that occur near the surface may be exploited by surface mining, a significant amount of heavy oil and bitumen reserves may occur in formations that are too deep for surface mining, typically referred to as "in situ" reservoirs or deposits because extraction must occur in situ or from within the reservoir or deposit. The recovery of heavy oil and/or bitumen in these in situ deposits may be hampered by the physical characteristics of the heavy oil and bitumen contained therein, particularly the viscosity of the heavy oil and/or bitumen. While there is no clear definition, heavy oil typically has a viscosity of greater than 100 mPa/s (100 cP), a gravity of 10° API to 17° API and tends to be mobile (e.g. capable of flow under gravity) under reservoir conditions, while bitumen typically has a viscosity of greater than 10,000 mPa/s (10,000 cP), a gravity of 7° API to 10° API and tends to be immobile (e.g. incapable of flow under gravity) under reservoir conditions. The above noted physical characteristics of the heavy oil and bitumen (collectively referred to as "heavy oil") typically renders these components difficult to recover from in situ deposits and, as such, in situ processes and/or technologies specific to these types of deposits are needed to efficiently exploit these resources.

Several techniques have been developed to recover heavy oil from in situ deposits, such as stream assisted gravity drainage (SAGD), as well as variations thereof using hydrocarbon solvents (e.g. VAPEX), steam flooding, cyclic steam stimulation (CSS) and in-situ combustion. These techniques involve attempts to reduce the viscosity of the heavy oil so that the heavy oil and bitumen can be mobilized toward production wells. One such method, SAGD, provides for steam injection and oil production to be carried out through separate wells. The SAGD configuration provides for an injector well which is substantially parallel to, and situated above a producer well, which lies horizontally near the bottom of the deposit. Thermal communication between the two wells is established, and as oil is mobilized and produced from the producer or production well, a steam chamber develops. Oil at the surface of the enlarging steam chamber is constantly mobilized by contact with steam and drains under the influence of gravity.

An alternative to SAGD, known as VAPEX, provides for the use of hydrocarbon solvents rather than steam. A hydrocarbon solvent or mixture of solvents such as propane, butane, ethane and the like can be injected into the reservoir or deposit through an injector well. Solvent fluid at the solvent fluid/oil interface dissolves in the heavy oil thereby decreasing its viscosity, causing the reduced or decreased viscosity heavy oil to flow under gravity to the production well. The hydrocarbon vapour forms a solvent fluid chamber, analogous to the steam chamber of SAGD.

It has been recognized, however, that these prior means used for the recovery of heavy oil from subterranean deposits need to be optimized.

SUMMARY OF THE INVENTION

An aspect of the present invention includes a method for extracting hydrocarbons from in a reservoir containing hydrocarbons having an array of wells disposed therein, the method comprising: (a) injecting a solvent fluid into the reservoir through a first well in the array; (b) producing reservoir fluid from a second well in the array, the second well offset from the first well, to drive the formation of a solvent fluid chamber between the first and the second well; (c) injecting the solvent fluid into the solvent fluid chamber through at least one of the first and second wells to expand the solvent fluid chamber within the reservoir; and (d) producing reservoir fluid from at least one well in the array to direct the expansion of the solvent fluid chamber within the reservoir.

An aspect of the present invention includes a method for extracting hydrocarbons from a reservoir containing hydrocarbons, the method comprising: (a) injecting a solvent fluid into the reservoir through a first well disposed in the reservoir; (b) producing reservoir fluid from a second well disposed in the reservoir and offset from the first well to create a pressure differential between the first and second well, the pressure differential being sufficient to overcome the gravity force of the solvent fluid so as to drive the formation of a solvent fluid chamber towards the second well.

Another aspect of the present invention includes a method for extracting hydrocarbons from a reservoir containing hydrocarbons, the method comprising: (a) injecting a solvent fluid into the reservoir through a first well disposed in the deposit; (b) producing reservoir fluid from a second well disposed in the reservoir and offset from the first well so as to drive the formation of a solvent fluid chamber towards the second well until solvent fluid breakthrough occurs at the second well; (c) injecting the solvent fluid into the solvent fluid chamber through the second well to increase the surface area of the solvent fluid chamber; and (d) producing reservoir fluid in the solvent fluid chamber from the first well.

Another aspect of the present invention includes a method for extracting hydrocarbons from a reservoir containing hydrocarbons, the method comprising: (a) injecting a solvent fluid into the reservoir through a first vertical well disposed in the deposit; (b) producing reservoir fluid from a second vertical well disposed in the reservoir offset from the first vertical well so as to drive the formation of a first solvent fluid chamber towards the second vertical well until solvent fluid breakthrough occurs at the second vertical well; (c) injecting the solvent fluid into the reservoir through a first horizontal well disposed in the deposit and offset from the first and second vertical wells so as to create a second solvent fluid chamber; and (d) producing reservoir fluid from the horizontal well and injecting solvent fluid into the first solvent chamber so as to drive the first solvent fluid chamber towards the second solvent fluid chamber.

Another aspect of the present invention includes a method for extracting hydrocarbons from a reservoir containing hydrocarbons, the method comprising: (a) injecting a solvent fluid into the reservoir through a first well disposed in the reservoir; (b) producing reservoir fluid from a second well disposed in the reservoir and offset from the first well to create a direct solvent fluid channel between the first and second well; (c) injecting solvent fluid into the reservoir from at least one of the first and second wells and producing reservoir fluid from at least one of the first and second wells to create at least two solvent fluid chambers, each of the solvent fluid chambers having "oil/solvent fluid" mixing and "solvent fluid/oil mixing".

BRIEF DESCRIPTION OF THE DRAWINGS

Various objects, features and attendant advantages of the present invention will become more fully appreciated and better understood when considered in conjunction with the accompanying drawings, in which like reference characters designate the same or similar parts throughout the several views.

DETAILED DESCRIPTION OF THE PREFERRED EMBODIMENT

Figure 1A:
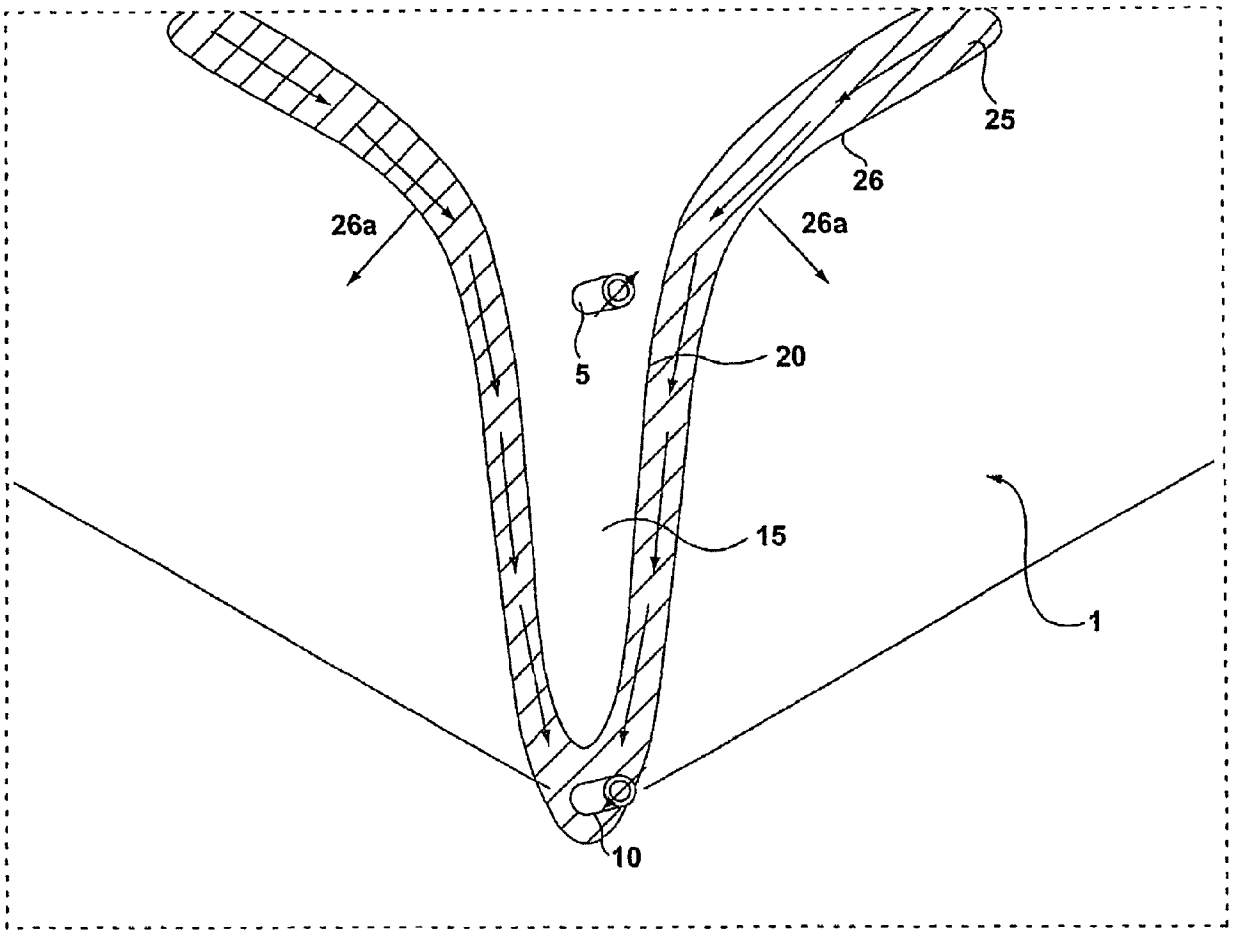
FIG. 1a (Prior Art)
FIGS. 1(*a*) and (*b*) are schematic perspective views of an array of horizontal wells.

In order that the invention may be more fully understood, it will now be described, by way of example, with reference to the accompanying drawings in which FIGS. 1 through 10 illustrate embodiments of the present invention.

In the description and drawings herein, and unless noted otherwise, the terms "vertical", "lateral" and "horizontal", can be references to a Cartesian co-ordinate system in which the vertical direction generally extends in an "up and down" orientation from bottom to top while the lateral direction generally extends in a "left to right" or "side to side" orientation. In addition, the horizontal direction generally extends in an orientation that is extending out from or into the page. Alternatively, the terms "horizontal" and "vertical" can be used to describe the orientation of a well within a reservoir or deposit. "Horizontal" wells are generally oriented parallel to or along a horizontal axis of a reservoir or deposit. The horizontal axis and thus the so-called "horizontal wells" may correspond to or be parallel to the horizontal, vertical or lateral direction as represented in the description and drawings. "Vertical" wells are generally oriented perpendicular to horizontal wells and are generally parallel to the vertical axis of the reservoir. As with the horizontal axis, the vertical axis and thus the so-called "vertical wells" may correspond to or be parallel to the horizontal, vertical or lateral direction as represented in the description and drawings. It will be understood that horizontal wells are generally 80° to 105° relative to the vertical axis of the reservoir or deposit, while vertical wells are generally perpendicular relative to the horizontal axis of the reservoir or deposit.

Many known methods of heavy oil recovery or production employ means of reducing the viscosity of the heavy oil located in the deposit so that the heavy oil will more readily flow under reservoir conditions to the production wells. Steam or solvent fluid flooding of the reservoir to produce a steam or solvent fluid chamber in SAGD and VAPEX processes may be used to reduce the viscosity of the heavy oil within the deposit. While a SAGD process reduces the viscosity of the heavy oil within the deposit through heat transfer, a VAPEX process reduces the viscosity by dissolution of the solvent into the heavy oil. Such techniques show potential for stimulating recovery of heavy oil that would otherwise be essentially unrecoverable. While these processes, particularly VAPEX, may potentially increase heavy oil production, these known processes may not sufficiently maximize recovery of the heavy oil so that the in situ deposit can be produced in an economically or cost efficient or effective manner. The objective of embodiments of the present invention is to improve recovery of heavy oil in these in-situ deposits so as to effectively, efficiently, and economically maximize heavy oil recovery. The embodiments of the present invention are directed to the use of a solvent fluid, which may consist of a solvent in a liquid or gaseous state or a mixture of gas and liquid, so as to effectively and efficiently maximize oil recovery by increasing the mixing process of the solvent fluid (e.g. either a solvent liquid or solvent fluid) with the heavy oil contained in the formation, thus improving the oil recovery from particular underground hydrocarbon formations.

The present invention is directed to producing a solvent fluid chamber having a desired configuration or geometry between at least two wells. In an aspect of the present invention, a solvent fluid chamber having a desired configuration or geometry is formed between one well that may be vertically, horizontally or laterally offset from another well so as to maximize the recovery of heavy oil from in-situ deposits. It will be understood by a person skilled in the art that the use of the term "offset" herein refers to wells that can be displaced relative to one another within the reservoir or deposit in a lateral, horizontal or vertical orientation. The solvent fluid may comprise steam, methane, butane, ethane, propane, pentanes, hexanes, heptanes, carbon dioxide ($CO_2$) or other solvent fluids which are well known in the art, either alone or in combination, as well as these solvent fluids or mixtures thereof mixed with other non-condensible gases. The solvent fluid (e.g. solvent liquid, gas or mixtures thereof) chamber configuration of the present invention provides for an increase in the surface area of the solvent fluid chamber that is in contact with heavy oil contained within the deposit. The increased contact between the fluid chamber and the heavy oil leads to increased mixing between the fluid (e.g. solvent liquid, gas or mixtures thereof) and the heavy oil. The increased mixing, in turn, leads to increased production of the heavy oil from a producing well. The fluid that is "produced" or flows into the producing well, typically in a liquid state, from within the deposit to the surface or elsewhere where it is collected typically comprises reduced or decreased viscosity heavy oil, solvent fluid, other components or mixtures thereof. This mixture of reduced viscosity heavy oil and other components has a viscosity less than that of heavy oil, namely 1 to 50 cP, and can be referred to as "decreased viscosity heavy oil", "reduced viscosity heavy oil" or "production oil". As noted above, heavy oil, namely heavy oil and bitumen have viscosities of between 100 to 5,000,000 Cp.

Figure 1B:
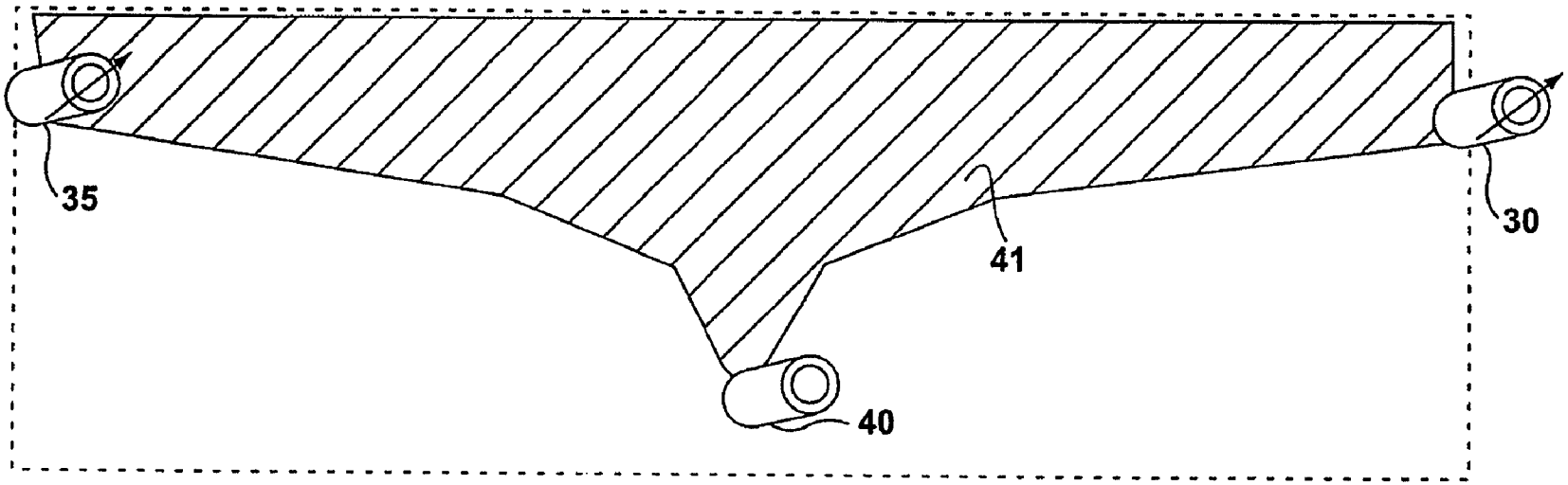
Figure 2:
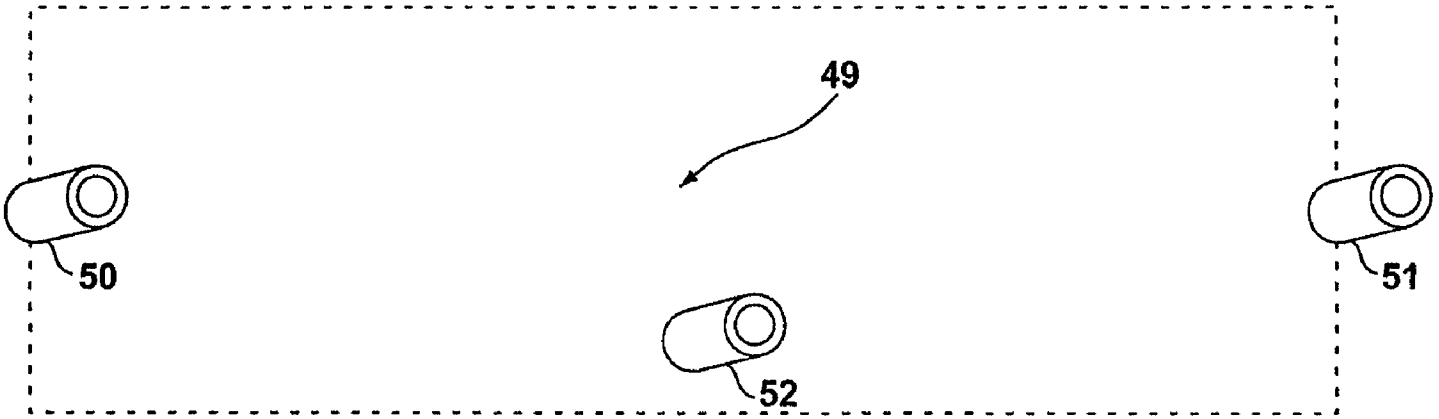
FIGS. 2 and 3 are schematic perspective views of an array of horizontal wells for use with embodiments of the present invention.

FIGS. 1(*a*) and 1(*b*) of the present application show an example of a known configuration of at least one injector well and one production well in a heavy oil deposit 1. As shown in FIG. 1(*a*), two vertically offset horizontal wells 5 and 10 are provided. These can be previously existing horizontal wells that may have been drilled for primary production or newly drilled wells for secondary production processes such as SAGD or VAPEX. Well 5 can be used to inject a solvent fluid, such as steam, propane, methane, etc., into deposit 1 so as to create a solvent fluid chamber 15 having an outer edge 20. Outer edge 20 has a given surface area that is in contact with the heavy oil of the deposit. The fluid along the surface area of the outer edge 20 of the fluid chamber 15 interfaces with the heavy oil contained within the deposit. If the fluid is a solvent fluid such as methane, propane, etc., the solvent fluid at the surface area of the solvent fluid chamber will mix with the heavy oil along the surface area of the fluid chamber through known mechanisms such as diffusion, dispersion, capillary mixing, etc. This "fluid over oil" surface area mixing between the solvent fluid and the heavy oil of the deposit will result in a decrease in the viscosity of the heavy oil located near outer edge 20. It will be understood that the term "fluid over oil" surface area mixing refers to the type of mixing that occurs when the fluid of the fluid chamber mixes into the heavy oil of the deposit by only diffusion, dispersion, capillary mixing, etc. and is unaided by the effects of gravity, and will be understood in greater detail below. At some point during the "fluid over oil" surface area mixing, the viscosity of the heavy oil along the surface area of the solvent fluid chamber will have been decreased sufficiently to form decreased viscosity heavy oil which will begin to flow to the production well 10 under the influence of gravity as indicated by the arrows provided in FIG. 1(*a*). If steam is used as the solvent fluid, it will be understood that while the steam per se does not mix with the heavy oil along the surface area, the heat of the steam will penetrate the heavy oil so as to decrease the viscosity of the heavy oil so as to begin or increase its flow under gravity. As a result of the mixing (such as, for example, if a solvent fluid is used in a gaseous state) or the heat transfer (such as, for example, if steam is used as the solvent fluid), a volume 25 along the horizontal well length of decreased viscosity oil having an outer edge 26 is formed allowing the improved viscosity heavy oil within area 25 to flow by gravity into production well 10 in the direction provided in the arrows of FIG. 1(*a*). As more solvent fluid or steam is injected into chamber 15 from well 5, fluid chamber 15 will begin to expand in the direction of arrows 26*a* to mix with the heavy oil contained in the deposit. As such, the outer edge or border 26 of mixed heavy oil and solvent fluid or steam will migrate or move through the deposit as the steam or gas mixes with the high viscosity heavy oil. In turn, the lower viscosity heavy oil and solvent fluid mixture will flow via gravity to the production well 10 thus reducing the overall amount of heavy oil in the deposit 1.

Similar to the configuration of FIG. 1(*a*), FIG. 1(*b*) provides three offset horizontal wells, two of which can be considered upper wells 30 and 35, laterally offset from one another, while the remaining well could be considered a lower well 40, laterally and vertically offset from upper wells 30 and 35. Similar to the process discussed in relation to FIG. 1(*a*), FIG. 1(*b*) provides that a solvent fluid is injected into the upper wells 30 and 35 to form a fluid chamber 41 such that the heavy oil either mixes with the solvent fluid (e.g. in the case of the methane, etc.) or receives the heat of the solvent fluid thereby decreasing or reducing the viscosity of the heavy oil which then flows under the influence of gravity to producing well 40.

In the prior art examples provided in FIGS. 1(*a*) and (*b*), it will be understood that the production of heavy oil from production wells 10 and 40 are limited by (a) the rate at which the decreased viscosity heavy oil or production oil flows under gravity to the production well (the "gravity drainage rate"); or (b) the rate of mixing of the solvent fluid within the solvent fluid chamber and the heavy oil contained within the reservoir or deposit (hereinafter referred to as the "solvent fluid/oil mixing rate"). Provided that the gravity drainage rate is not the rate limiting factor under reservoir conditions, the production of decreased viscosity heavy oil or production oil will generally be determined by the amount of decreased viscosity heavy oil or production oil, that has a viscosity sufficiently low to flow under gravity to the production well. This in turn will be dependent upon the solvent fluid/oil mixing rate. The solvent fluid/oil mixing rate is influenced by the surface area of the solvent fluid chamber through which the heavy oil and the solvent fluid of the solvent fluid chamber can interact and by any mechanisms which lead to mixing of the heavy oil and the solvent fluid. In other words, if there is an increase in the surface area of the solvent fluid chamber so as to increase the solvent fluid/oil contact area, the solvent fluid/oil mixing rate will increase. In addition, any mechanisms which can lead to increased oil and solvent fluid mixing will increase the solvent fluid/oil mixing rate which in turn leads to an increase in the production of decreased viscosity heavy oil (i.e. production oil) from the reservoir. In order to maximize production from the producing well, it is desirable, therefore, to maximize the solvent fluid/oil mixing rate.

The present invention is directed, therefore, to maximizing the solvent fluid/oil mixing rate by increasing the surface area mixing of the solvent fluid in the solvent fluid chamber with the heavy oil of the deposit through directing the creation and maintenance of a solvent fluid chamber having a desired configuration or geometry. The solvent fluid chamber of the present invention has an increased surface area over solvent fluid chambers created using previously known methods of heavy oil production such as SAGD and VAPEX. Embodiments of the present invention provide for the use of horizontal or vertical production/injection wells as well as combinations thereof to direct and/or maintain the formation of a solvent fluid chamber having a geometry or configuration so as to maximize the solvent fluid/oil mixing rate by increasing the surface area mixing of the solvent fluid in the solvent fluid chamber with the heavy oil. The embodiments of the present invention involve directing and maintaining the creation or development of a solvent fluid chamber having a desired geometry or configuration between offset horizontal or vertical injection and production wells through the use of simultaneous solvent fluid injection and reservoir fluid production between the offset wells and alternating injection and production between them.

In accordance with the present invention, a solvent fluid chamber having the desired geometry or configuration can be formed between two vertically, horizontally or laterally offset wells so as to provide for increased mixing of the solvent fluid and heavy oil. The wells of the present invention could be either generally vertical or generally horizontal wells or combinations thereof. The solvent fluid chamber of the present invention increases the mixing of the solvent fluid within the solvent fluid chamber and the heavy oil of the deposit by providing increased surface area of the solvent fluid chamber, which provides for both "fluid over oil" mixing and "oil over fluid" mixing. "Fluid over oil" mixing is discussed above in relation to FIGS. 1(*a*) and 1(*b*). It will be understood that "oil over fluid" mixing refers to the mixing that occurs when the solvent fluid of the solvent fluid chamber lies underneath the heavy oil of the deposit. In other words, it will be understood that at least a portion of the surface area of the solvent fluid chamber is disposed vertically below the heavy oil in the deposit. As a result of this configuration, the mixing of the heavy oil and the solvent fluid within the solvent fluid chamber will be increased relative to those chambers which provide predominately "fluid over oil" mixing. In "fluid over oil" mixing, the solvent fluid mixes with the heavy oil under known mechanisms such as diffusion, dispersion, capillary mixing, etc. However, with "oil over fluid" surface area mixing there is an additional mixing force at work, namely gravity. As the solvent fluid of the solvent fluid chamber typically has a lower density or is "lighter" than the heavy oil within the deposit, the fluid will tend to be influenced to migrate into the heavy oil due to its buoyancy. This method of mixing could be described as gravity induced counter-flow mixing of upper heavier oil with a lower lighter solvent fluid. Also, the heavy oil above the solvent fluid will also be influenced to migrate into the fluid chamber due to its higher density. In effect, the mixing of the solvent fluid and the heavy oil is increased due to the effect of the migration tendency of the solvent fluid into the heavy oil and vice versa. As a result, the solvent fluid chamber of the present invention increases the fluid/oil mixing rate due to the increases in surface area and the increases in overall mixing rate due to the additional mixing of oil over fluid mixing not present in prior art methods of heavy oil production.

Solvent Fluid Chamber Creation Using Horizontal Wells

As shown in FIGS. 2 to 5, one embodiment of the present invention provides for the creation of a solvent fluid chamber between horizontal wells vertically and laterally offset from one another. As provided in FIGS. 2 and 3, horizontal wells 50 and 51 can be drilled generally parallel to one another and generally parallel to the longitudinal axis of reservoir or deposit 49 in an upper portion of in situ reservoir or deposit 49 having heavy oil contained therein. In FIGS. 2 to 5, the longitudinal axis of deposit 49 would be extending outwardly from the page, e.g. in a horizontal orientation, towards the viewer. Horizontal well 52 can also be infill drilled so as to be offset vertically and laterally from horizontal wells 50 and 51. It will be understood that existing wells from previous production of in situ deposit 49, which may have been previously drilled, may also be used. For example, horizontal wells 50, 51 or 52 may have been used in primary production of deposit 49.

Figure 3:
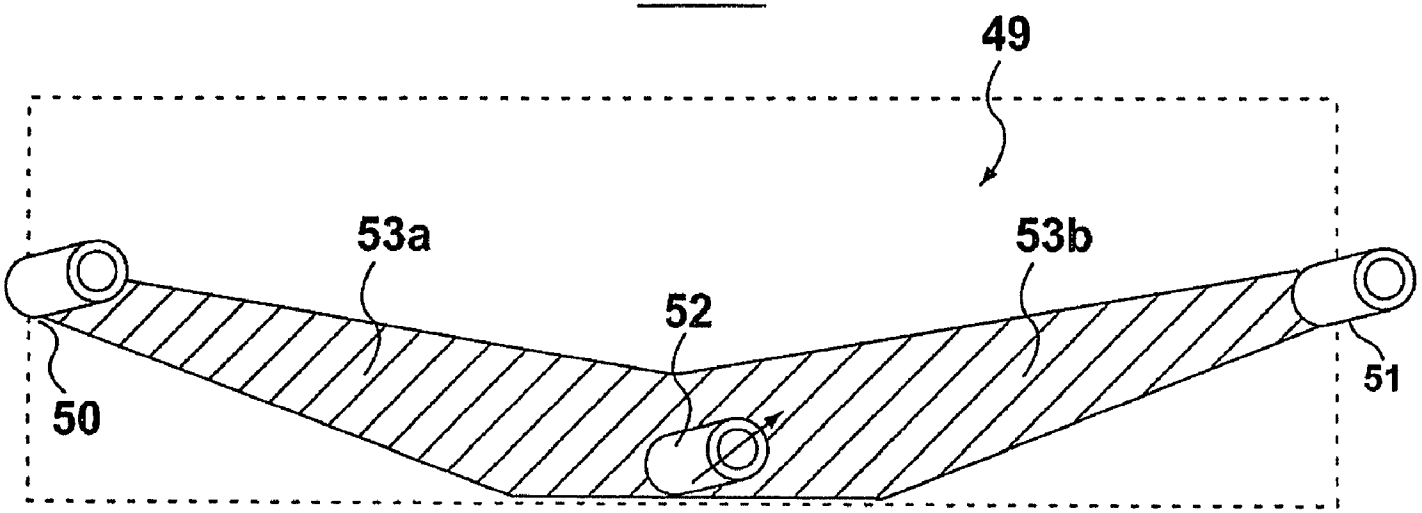

As shown in FIG. 3, solvent fluid (such as methane, propane, etc.) can be injected into horizontal well 52 while "reservoir fluid", which can consist of one or more of decreased viscosity heavy oil (e.g. production oil), water, pre-existing formation gas (e.g. natural gas) or solvent fluid is produced from horizontal wells 50 and 51. Production at horizontal wells 50 and 51 continues until a significant amount (i.e. greater than 50%) of the reservoir fluid produced at wells 50 and 51 is solvent fluid. In other words, as production proceeds at wells 50 and 51, the percentage of solvent fluid of the total reservoir fluid produced will increase, while the percentage of the other components of the reservoir fluid produced will decrease. When the percentage of the solvent fluid is generally greater than 50% of the solvent fluid produced relative to the total reservoir fluid produced, significant solvent fluid "breakthrough" has occurred. As production proceeds at well 50 while solvent fluid is simultaneously injected into deposit 49 via well 52, a solvent fluid chamber 53*a* will be created (see FIG. 3) that is oriented away from well 52 towards well 50. In general, and as shown in FIG. 3, the solvent fluid chamber is delimited by upper and lower upwardly inclined boundaries. The upper and lower upwardly inclined boundaries converge towards well 50. Solvent fluid chamber 53*a* may, for the purposes of illustration in FIG. 3 and not to be considered limiting, have a generally elongated wedge shape with the apex generally oriented towards well 50 and the elongated base oriented towards and extending along the horizontal length of well 52. The volume of the elongated wedge base is generally largest nearest the injection well (e.g. well 50 in FIG. 3) as this area tends to have the highest volume of solvent fluid. As the process described herein proceeds, the solvent fluid chamber will continue to expand as more solvent fluid is injected. It will be understood however, that the specific configuration or geometry of solvent fluid chamber 53*a* will be dictated by reservoir conditions and by the injection and production procedures as described herein. Similarly, as production proceeds at well 51 while solvent fluid is injected into deposit 49 via well 52, a second solvent fluid chamber 53*b*, similar in configuration and geometry to solvent fluid chamber 53*a* as noted above, will be created.

As shown in FIG. 3, each of solvent chambers 53*a* and 53*b* are angled or formed "diagonally" between injection well 52 and each of wells 50 or 51. An aspect of the present invention is to create an upwardly inclined solvent fluid chamber for each pair of injection and production wells (e.g. 50 and 52 or 51 and 52), the upwardly inclined solvent fluid chambers each delimited by upper and lower upwardly inclined boundries which tend to converge towards the upper well (e.g. 50).

The conditions under which this angled or diagonal solvent fluid chamber is formed between each pair of injection and production wells will depend on the specific reservoir conditions, such as horizontal and vertical permeability as well as the viscosity of the heavy oil in the deposit or reservoir. In other words, the reservoir conditions will determine or dictate the injection or production pressures and rates as well as pressure gradients through which the solvent fluid chambers of the present invention are formed and maintained. The conditions that will likely determine the formation of the solvent fluid chamber in accordance with the present invention include the rates and pressures at which a solvent fluid may be injected into a deposit, the horizontal and vertical permeability of a deposit, the rate or pressure of production at the producing wells and the pressure differential between the injection and production wells. The flow rate of fluid through a permeable matrix is proportionate to the permeability and inversely proportionate to the viscosity of the fluid. Hence, high permeability and low viscosity oil will result in and require high injection and production rates. In order to direct the creation, formation or maintenance of the upwardly inclined diagonal fluid chamber, the injected fluid must be forced or driven towards the production well and should not be allowed to rise or gravity override to the top of the reservoir as shown in FIG. 1(*b*). In other words, the viscous forces created by pressure differentials and high flow rates should overcome or dominate the gravity or buoyancy force of the lighter injected solvent fluid. It will be understood that as the horizontal and vertical permeability of the deposit increases and/or the viscosity of the heavy oil located therein decreases, the ability of the solvent fluid to transverse the deposit will increase. To avoid a gravity overriding solvent chamber, as described herein, the creation, formation or maintenance of the solvent fluid chamber should be directed by increasing or maximizing the injection rate at the injection well and increasing or maximizing the production rate at the production wells to accommodate the permeability and viscosity conditions of the deposit.

In general, the solvent fluid injection rate should be as much or as fast as possible given the horizontal and vertical permeability of the deposit as well as the viscosity of the heavy oil (i.e. heavy oil and bitumen) deposited therein. Injection rates will generally be high if the horizontal or vertical permeability is high and/or the viscosity of the heavy oil is low and vice versa. In other words, the higher the permeability, the higher the injection rate; conversely, solvent fluid injection rates tend to be lower the higher the viscosity of the heavy oil in the deposit or reservoir. If the horizontal and vertical permeability of the deposit is high (e.g. generally exceeding 500 millidarcies (mD)), the injection rate should be correspondingly high. Similarly, the production rate at the producing wells should be as high as possible given a particular horizontal and vertical permeability of a given deposit and the viscosity of the heavy oil deposited therein.

By injecting the solvent fluid at a sufficiently high rate as noted herein and producing the reservoir fluid at a sufficiently high rate as noted herein, a pressure gradient is created so as to direct flow of the solvent fluid towards the production wells away from the injection wells to create an angled or diagonal solvent fluid chamber of the type or geometry as described herein. This directed flow arises because the solvent fluid channels through deposit 49 to create the solvent fluid chamber of the disclosed configuration or geometry. The solvent fluid channelling or preference direct flow arises because the solvent fluid, particularly when it is a gas, will tend to move or "channel" through the deposit due to the pressure differential created between the injection and production wells.

It will be understood that the actual or specific injection and production rates may not be a significant factor as each will likely depend on the reservoir conditions. The directed formation of the solvent fluid chamber of the desired configuration or geometry may be more influenced by the creation of a pressure gradient or pressure difference between the injection and production wells. Subject to equipment tolerances, the injection rates and/or production rates should be as high as possible under specific reservoir conditions.

Figure 4:
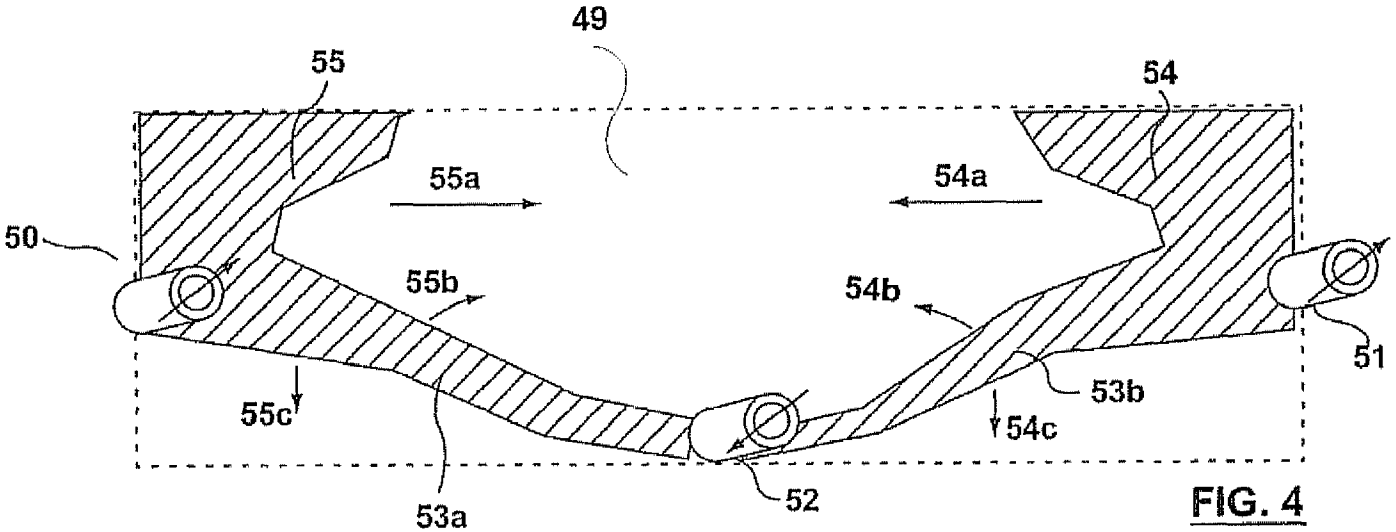
FIGS. 4 and 5 are schematic end views of an array of horizontal wells for use with embodiments of the present invention.
Figure 5:
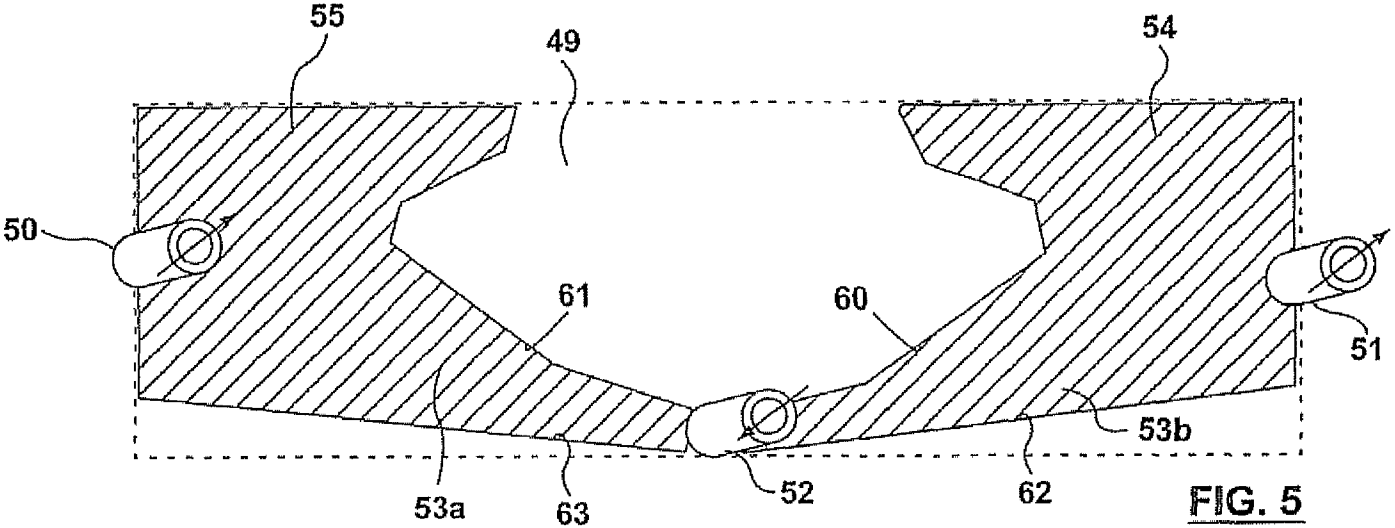

As shown in FIGS. 3 to 5, the solvent fluid injected into the deposit 49 via well 52 will tend to channel towards wells 51 and 50 to form two angled or diagonal solvent fluid chambers 53*a* and 53*b*. As noted above, the specific conditions under which the angled or diagonal solvent fluid chambers can be created will vary for each reservoir depending on the reservoir conditions as noted above. In order to form diagonal solvent fluid chambers, such as chamber 53*a* between wells 50 and 52, as well as chamber 53*b* between wells 51 and 52, the rate at which the solvent fluid can be injected into well 52 should preferably be as high as possible so that injected solvent fluid directly channels through the heavy oil to wells 50 and 51, respectively. Injection of the solvent fluid into well 52 must be at rates sufficiently high to induce solvent fluid channelling of the injected solvent fluid. Such injection rates may be greater than 14,000 standard cubic meters per day (500,000 standard cubic feet per day). It is also important to produce wells 50 and 51 at the highest rates as possible so as to produce the desired pressure gradient. As such, an embodiment of the present invention provides for a pressure gradient exceeding 100 kPa up to a maximum not exceeding the fracture pressure of the formation (e.g. when the deposit or reservoir breaks apart) for heavy oil. It may even be necessary to exceed the fracture pressure if the viscosity is particularly high, such as for bitumen.

If injection rates, production rates and pressure gradients are not sufficiently high for a given reservoir, the injected solvent fluid will preferentially rise to the top of the reservoir due to its natural buoyancy and form a solvent fluid chamber as shown in FIGS. 1(*a*) and 1(*b*). Such a solvent fluid chamber is known as a gravity overriding solvent chamber. An additional benefit of sufficiently high solvent fluid injection rates, high production rates and high pressure gradients between the wells is that solvent fluid injection and the diagonal solvent fluid chamber should occur along most of the length of the horizontal well. At low rates and low pressure gradients between the wells, the solvent fluid injection and chamber formation may only occur along less than 50% of the length of the horizontal well resulting in low rates of oil production. However, the present invention provides for solvent fluid chamber formation in greater than 50% the length of the horizontal well.

As shown in FIG. 3, solvent fluid chambers 53*a* and 53*b* having the desired configuration and geometry can be formed between injection well 52 and production wells 50 and 51 upon solvent fluid breakthrough at wells 50 and 51. As such, well 52 is in solvent fluid contact with wells 50 and 51. Once the solvent fluid has reached wells 50 and 51 so as to establish the angled or diagonal fluid chambers 53*a* and 53*b*, wells 50 and 51 are switched from production of reservoir fluid to injection of solvent fluid into deposit 49. Upon solvent fluid breakthrough, well 52 can be simultaneously switched from injection of solvent fluid to production of reservoir fluid, including improved viscosity heavy oil and solvent fluid. As shown in FIGS. 4 and 5, solvent fluid can be injected into deposit 49 via wells 50 and 51 while reservoir fluid is produced at well 52. In doing so, additional solvent fluid chambers 55 and 54 are formed. Reservoir fluid, including decreased viscosity heavy oil or production oil and solvent fluid is then produced from well 52. As shown in FIGS. 4 and 5, solvent fluid is continuously injected into wells 50 and 51 such that solvent fluid chambers 53*a*, 53*b*, 54 and 55 expand in the directions of arrows 54*a,b,c* and 55*a,b,c* (see FIG. 4), such that reservoir fluid can be produced from well 52. Eventually, continuous solvent fluid injection into wells 50 and 51 and continuous production from well 52 can occur until the deposit has had a significant portion, such as 20-80%, of the heavy oil extracted.

It will be understood that some or all these steps can then be repeated if, for example, (a) if the solvent chamber configuration or geometry is not achieved or is lost (e.g. converts to a gravity overriding solvent chamber) due to equipment failure or the process stopped for whatever reason and the solvent fluid chamber needs to be re-created; or (b) the configuration, geometry or size of the solvent fluid chamber need to be optimized (e.g. not extending greater than 50% the length of the horizontal well). It will be understood that prior to production at wells 50 and 51, solvent fluid injection into these wells can be done, particularly in the presence of reservoirs with high bitumen content.

Unlike prior art methods, such as those shown in FIGS. 1(*a*) and 1(*b*),the above noted embodiment of the present invention provides for an increase in the recovery of heavy oil contained in deposit 49. As noted above, the rate of heavy oil recovery will be dependent on the mixing of the solvent fluid within the solvent fluid chamber and the heavy oil, namely the "fluid/oil mixing rate". Unlike the prior art methods noted in FIGS. 1(*a*) and 1(*b*), this embodiment of the present invention provides for both "fluid over oil" surface area mixing as well as "oil over fluid" surface area mixing. Gravity overriding solvent fluid chambers 15 and 41 of FIGS. 1(*a*) and 1(*b*) provide only "fluid over oil" surface area mixing. This is in contrast to solvent fluid chambers having the desired configuration or geometry taught herein as shown in FIGS. 3 to 5. As shown in FIG. 5, the diagonal solvent fluid chambers have two areas of solvent fluid and oil surface area mixing, namely upper surface 60, 61 and lower surface 62, 63 of solvent fluid chambers 53*a* and 53*b*. "Fluid over oil" mixing will occur at lower surfaces 62 and 63 of solvent fluid chambers 53*a* and 53*b*, respectively. Similarly, there will be "fluid over oil" surface area mixing along the lower surfaces of solvent fluid chambers 54 and 55. In addition to the "fluid over oil" mixing occurring at those surfaces, there will also be "oil over fluid" surface area mixing at the upper surfaces of solvent chambers 53*a* and 53*b*. As such there will be increased mixing in the "diagonal" solvent fluid chambers of the present invention over the methods known in the prior art. The increased solvent fluid and oil mixing will result in a higher production at well 52.

Eventually, continuous solvent fluid injection into horizontal wells 50 and 51 and continuous production from horizontal well 52 can occur until deposit or reservoir 49 has had a significant portion, such as 20 to 80% of the heavy oil extracted. Likewise, injection rates into the horizontal wells can be adjusted to maximize the recovery of heavy oil. If injection and production rates are too low, a gravity overriding chamber could form, reducing the recovery of heavy oil. Injection and production rates must be sufficiently high to maintain the diagonal or directed chamber. If injection rate is too high, more solvent may break through and may need to be re-injected and re-cycled. It will be understood that as heavy oil is being extracted from the area surrounding wells 50, 51 and 52, then extracting using the process noted above can concurrently or subsequently be implemented to other existing or infill drilled horizontal wells (not shown) within reservoir 49.

As the present invention provides for the creation of an angled or diagonal solvent fluid chamber between an injection horizontal well and an offset producing horizontal well, it will be understood that factors that may impact the solvent fluid channelling through the deposit may have an impact on the process of the invention. For example, in formations where bottom water present, the presence of bottom water may assist in the formation of the diagonal solvent fluid chamber due to the increased mobility of the solvent fluid through the water at the top of the oil-water transition zone.

Solvent Fluid Chamber Creation Using Horizontal and Vertical Wells

As shown in FIGS. 6 to 10, another embodiment of the present invention provides for the use of horizontal and vertical production and injection wells to direct the formation of solvent fluid chambers having a desired geometry or configuration. Instead of using horizontal wells only, this embodiment involves recovery using vertical injection/production wells as well as horizontal injection/production wells. This embodiment involves directing and maintaining the creation or development of a solvent fluid chamber having a desired geometry or configuration between offset vertical injection and production wells with horizontal production and injection wells through the use of simultaneous solvent fluid injection and reservoir fluid production between the offset vertical and horizontal wells and alternating the injection and production between them.

As with the other embodiment of the present invention, the objective of this embodiment is to obtain improved mixing of solvent fluid with heavy oil so as to reduce the viscosity of an increased amount of heavy oil allowing decreased viscosity heavy oil or production oil to be produced. Instead of using horizontal wells only, this embodiment involves recovery or production using vertical injection or production wells. This embodiment involves the creation of a solvent fluid chamber between vertical injection and production wells and with offset horizontal production and injection wells.

In the heavy oil reservoir with or without existing vertical wells, the configuration or geometry of the solvent fluid chamber is determined by use of alternating the injection of solvent fluid and the production of reservoir fluid, containing production oil, through the use of vertical and horizontal wells. For example, vertical wells can be drilled (if no existing vertical wells) and, offset to these vertical wells, parallel horizontal producing wells can be drilled (if no pre-existing wells) close to the bottom of the formation (e.g. within 1 meter). In this embodiment, a solvent fluid chamber is first established between the vertical injection wells. This is accomplished by injecting solvent fluid and producing reservoir fluid simultaneously between paired vertical wells. For example, solvent fluid can be injected into a first vertical well while producing a second vertical well until significant solvent fluid breakthrough occurs. Solvent fluid can also be injected next into the first and second vertical well while producing from an offset third vertical well for a desired time. This process is continued until a solvent fluid chamber has the desired geometry or configuration. Solvent fluid can then be injected into a horizontal well at pressures higher than at the vertical wells so as create a second solvent fluid chamber, thus reducing the viscosity of the surrounding heavy oil. Solvent fluid can be injected into the vertical wells and reservoir fluid, and then production oil, can be produced from the horizontal wells until depletion of the reservoir.

Figure 6:
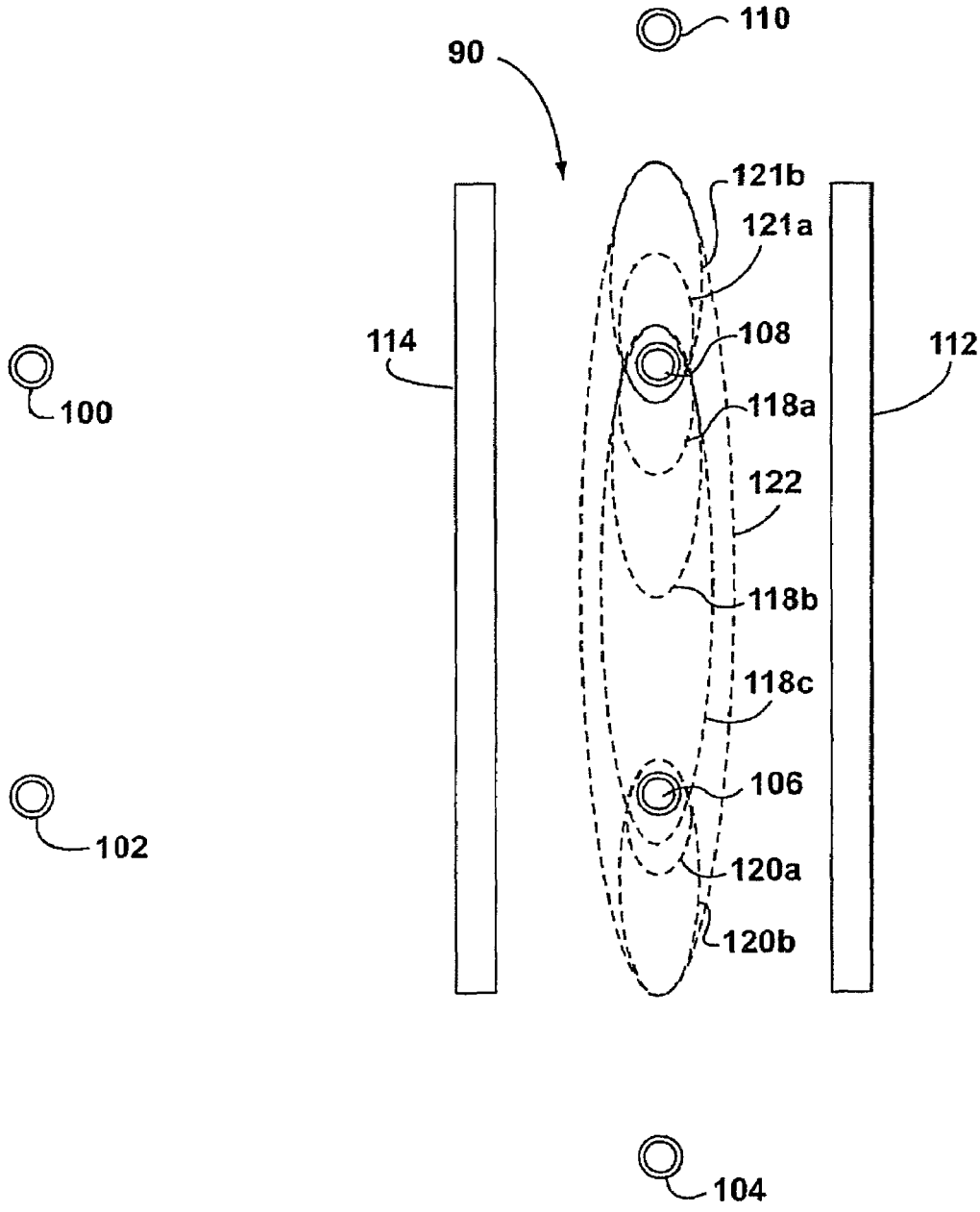
FIGS. 6 to 8 are schematic plan views of an array of horizontal and vertical wells for use with embodiments of the present invention.

As shown in FIG. 6, there are existing or infill drilled vertical wells 100, 102, 104, 106, 108 and 110 in a typical spatial arrangement of vertical production and injection wells within reservoir or deposit 90. It will be understood that the injection pattern can be selected based on the location of existing wells, reservoir size and shape, cost of new wells and the recovery increase associated with the various possible injection or production patterns. Common injection patterns are direct line drive, staggered line drive, two-spot, three-spot, four-spot, five-spot, seven-spot and nine-spot.

Solvent fluid can be first injected into deposit 90 through vertical well 108. Simultaneously, reservoir fluid is produced at vertical well 106. For reasons noted above, this will induce the formation of solvent fluid chamber 118*a*, as shown in FIG. 6. As the solvent fluid is injected into reservoir 90 through well 108 while reservoir fluid is produced at well 106, solvent fluid chamber 118*a* will expand to 118*b* and eventually 118*c*, at which point solvent fluid breakthrough can occur. As a result, a continuous solvent fluid chamber 118*c* is created between wells 108 and 106. As noted above with respect to solvent fluid chamber 53*a*, solvent fluid chamber 118*c* has a generally conical shape preferentially distorted in the direction of well 106. The generally conical shape of solvent fluid chamber 118*c* is oriented in the vertical direction with its longitudinal axis parallel to the vertical axis of well 108. The conical apex of solvent fluid chamber 118*c* is generally oriented away from the upper portion of vertical well 108 and deposit 90 and points towards the lower portion of vertical well 108 and deposit 90, while the conical base is generally oriented towards the upper portion of well 108 and deposit 90. The conical base is generally widest nearest the upper portion of injection well 108 as this area tends to have the highest concentration of solvent fluid. As the process described herein proceeds, solvent fluid chamber 118*c* will expand both at the conical base and the conical apex outwardly from vertical well 108 as more solvent fluid is injected. It will be understood however, that the specific configuration or geometry of solvent fluid chamber 118*c* will be dictated by reservoir conditions.

As noted previously, the solvent fluid injection rate at 108 and reservoir fluid production rate at well 106 must be sufficiently high for the solvent fluid to channel as directly as possible from well 108 towards well 106 possibly at solvent fluid injection rates exceeding 3,000 standard cubic meters per day (100,000 standard cubic feet per day). It is also important that the pressure gradient between 108 and 106 be very high as possible, possibly exceeding 100 kPa pressure. The solvent fluid breakthrough and flow between these vertical wells must be enough in volume and time to create a stable and reasonable sized solvent fluid chamber 118*c*. The solvent fluid breakthrough and cycling time between these wells should be one or more months long. The reservoir conditions (e.g. net oil pay, porosity and permeability) and field application (e.g. distance between wells and injection and productions rates) will determine the solvent fluid injection rate, volume and time.

If solvent fluid breakthrough does not occur then one or more infill vertical wells between wells 106 and 108 can be drilled (not shown). It will be understood that several reasons could account for the failure of the solvent fluid to break through, such as reservoir discontinuity, geological barriers, poor permeability or the inter-well distance is too great due to the high viscosity of the heavy oil. For example, if an infill vertical well was made between wells 106 and 108, solvent fluid injection could continue at well 108 with simultaneous reservoir fluid production from newly infill drilled adjacent vertical well until significant solvent fluid breakthrough occurs at the newly infill drilled adjacent vertical well. Once solvent breakthrough occurs at the newly infill drilled adjacent vertical well, solvent fluid injection can cease at vertical well 108 while the newly infill drilled adjacent vertical well switches from production to injection of solvent fluid. The solvent fluid can then be injected into the newly infill drilled adjacent vertical well while producing from next adjacent well such as vertical well 106 until solvent fluid breakthrough occurs at well 106.

Following solvent fluid breakthrough at well 106, solvent fluid injection at well 108 continues while well 106 is converted from production to solvent fluid injection. In other words, vertical well 106 is used to inject solvent fluid into fluid chamber 118*c*. Production is switched to vertical wells 104 and 110. For the reasons noted above, a pressure gradient will be created through which the solvent fluid chamber 118*c* will expand towards wells 110 and 104. As with the solvent fluid chamber development between 106 and 108, solvent fluid injection rates, reservoir fluid production rates and the pressure gradient between the injection and production wells must be sufficiently high for the solvent fluid to channel from 106 towards 104 and from 108 towards 110. As shown in FIG. 6, solvent fluid chamber 121*a* is created by the simultaneous production of reservoir fluid at well 110 and the injection of solvent fluid at well 108. As this simultaneous production and injection proceeds, solvent chamber 121*a* expands to 121*b*. Similarly, solvent fluid chamber 120*a* is created by the simultaneous production of reservoir fluid at well 104 and the injection of solvent fluid at well 106. As this simultaneous production and injection proceeds, solvent chamber 120*a* expands to 120*b*. It is not necessary for solvent fluid chambers 121*b* and 120*b* to extend to the point of solvent breakthrough at wells 110 and 104 respectively. Typically, the elongated gas chambers around the vertical wells should be slightly greater in length than the adjacent horizontal wells. However, it will be understood that the process could proceed until solvent fluid breakthrough occurs at wells 110 or 104. As shown in FIG. 6, simultaneous injection and production at wells 104, 106, 108 and 110 as noted above results in the formation of solvent fluid chamber 122.

Once the solvent fluid chamber 122 has between established, injection of solvent fluid into these wells and into the solvent fluid channels and chamber is similar to injecting solvent fluid into a hypothetical horizontal well extending between these wells and along the solvent fluid channel. Simply, the vertical wells in conjunction with the solvent fluid channel and chamber should act like a horizontal well. Unlike horizontal well injection, the injection and production rates can be adjusted between the vertical wells providing some control over the injection profile into the solvent fluid chamber and its composition. When solvent is injected into a horizontal well, most of the solvent could preferentially enter the reservoir in certain parts of the horizontal well bore resulting in a poor uneven injection profile. If 2-4 vertical wells act as a horizontal well, having control over the injection of each vertical well provides some control over the injection profile into the solvent chamber.

Figure 7:
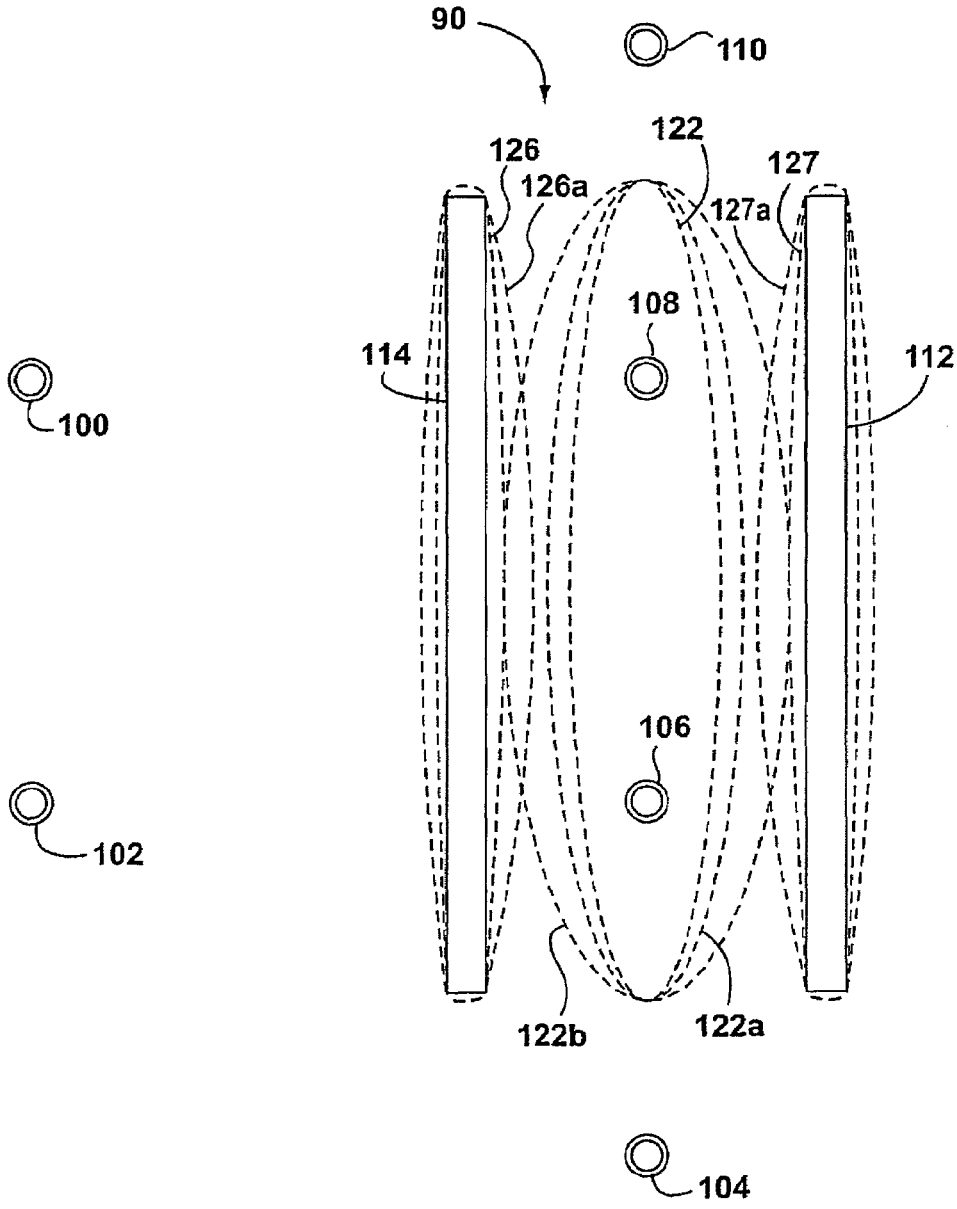

Upon formation of solvent fluid chamber 122 as shown in FIG. 7, solvent fluid can then be injected into new or previously existing horizontal wells 112 and 114 either simultaneously or alternately ( e.g. inject solvent into 112 and shut in or produce 114 then inject into 114 and shut in or produce 112 ) at injection pressures higher than the reservoir pressures at vertical wells 106 and 108, and the reservoir pressure of solvent fluid chamber 122 between 106 and 108, as it will be understood that the reservoir pressures at wells 106 and 108 or in chamber 122 may not be the same. The injection pressures and/or rates at horizontal wells 112 and 114 should be as high as possible as noted above in order to direct the injected solvent fluid to channel laterally outwards from horizontal wells 112 and 114 towards vertical wells 106 and 108, respectively and solvent fluid chamber 122, as shown in FIG. 7. If there is no production at wells 108 and 106, the only pressure forcing the solvent fluid chamber to expand is the injection pressure from wells 112 and 114. However, there can be injection or production at wells 106 and 108, if needed, depending on reservoir conditions to create the solvent fluid chamber having the desired configuration. In addition to the pressure or rates being sufficiently high to direct the formation of horizontal solvent fluid chambers 126 and 127 laterally towards vertical fluid chamber 122, the solvent fluid injection pressures or rates must also be sufficient to create these solvent fluid chambers along most (e.g. greater than 50%) of the longituntial length of each of horizontal wells 112 and 114. As shown in FIG. 7, horizontal wells 112 and 114 inject solvent fluid into reservoir or deposit 90 to create horizontal solvent fluid chambers 126 and 127. Solvent fluid chambers 126 and 127 are generally fusiformed or spindle shaped but distorted laterally and upwards along the horizontal axis of wells 112 and 114.

Figure 8:
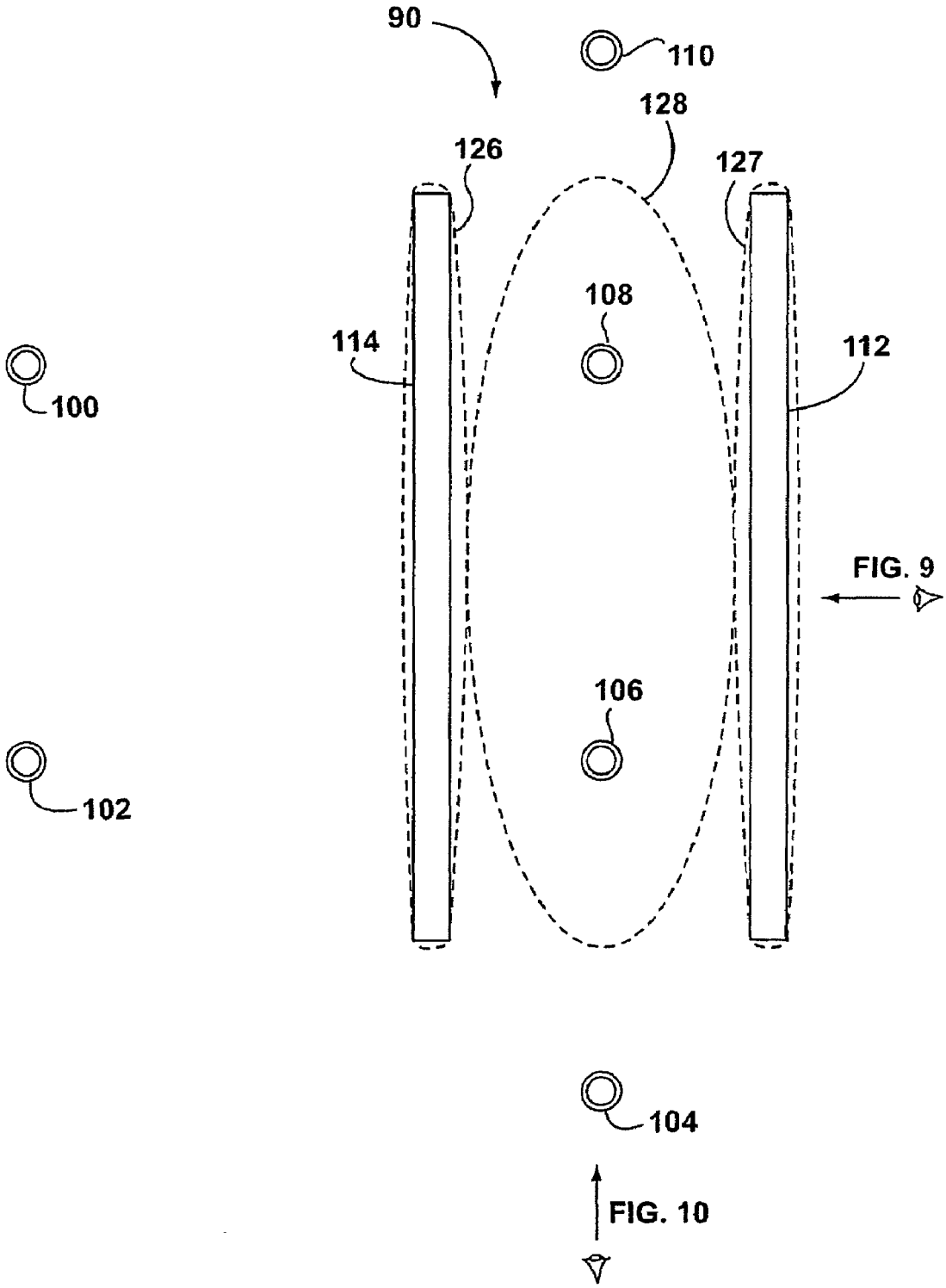

Horizontal wells 112 and 114 are then converted to production of reservoir fluid, while vertical wells 106 and 108 continue to inject solvent fluid into solvent fluid chamber 122. For the reasons noted herein, a pressure gradient will be created through which the solvent fluid chamber 122 will expand laterally towards wells 112 and 114, as shown in FIGS. 7 and 8. As with the solvent fluid chamber development between the vertical wells, fluid injection rates, reservoir fluid production rates and the pressure gradient between the vertical injection wells 106 and 108 as well as the horizontal production wells 114 and 112 must be sufficiently high for the solvent fluid to channel from existing solvent fluid chamber 122 towards horizontal solvent fluid chambers 126 and 127. As shown in FIG. 7, solvent fluid chamber 122 expands laterally into 122*a* due to the simultaneous production of reservoir fluid at wells 112 and 114 and the injection of solvent fluid at wells 106 and 108. As this simultaneous production and injection proceeds, solvent chambers 122*a*, 126 and 127 expand to 122*b*, 126*a* and 127*a*, respectively. This process continues until the expanding solvent fluid chamber 122, 122*a* and 122*b* converge with the expanding solvent fluid chambers 126, 126*a*, 127 and 127*a*. As shown in FIG. 8, solvent fluid chamber 128 is in solvent fluid connection with fluid chambers 126 and 127 (also see FIGS. 9 and 10).

Figure 9:
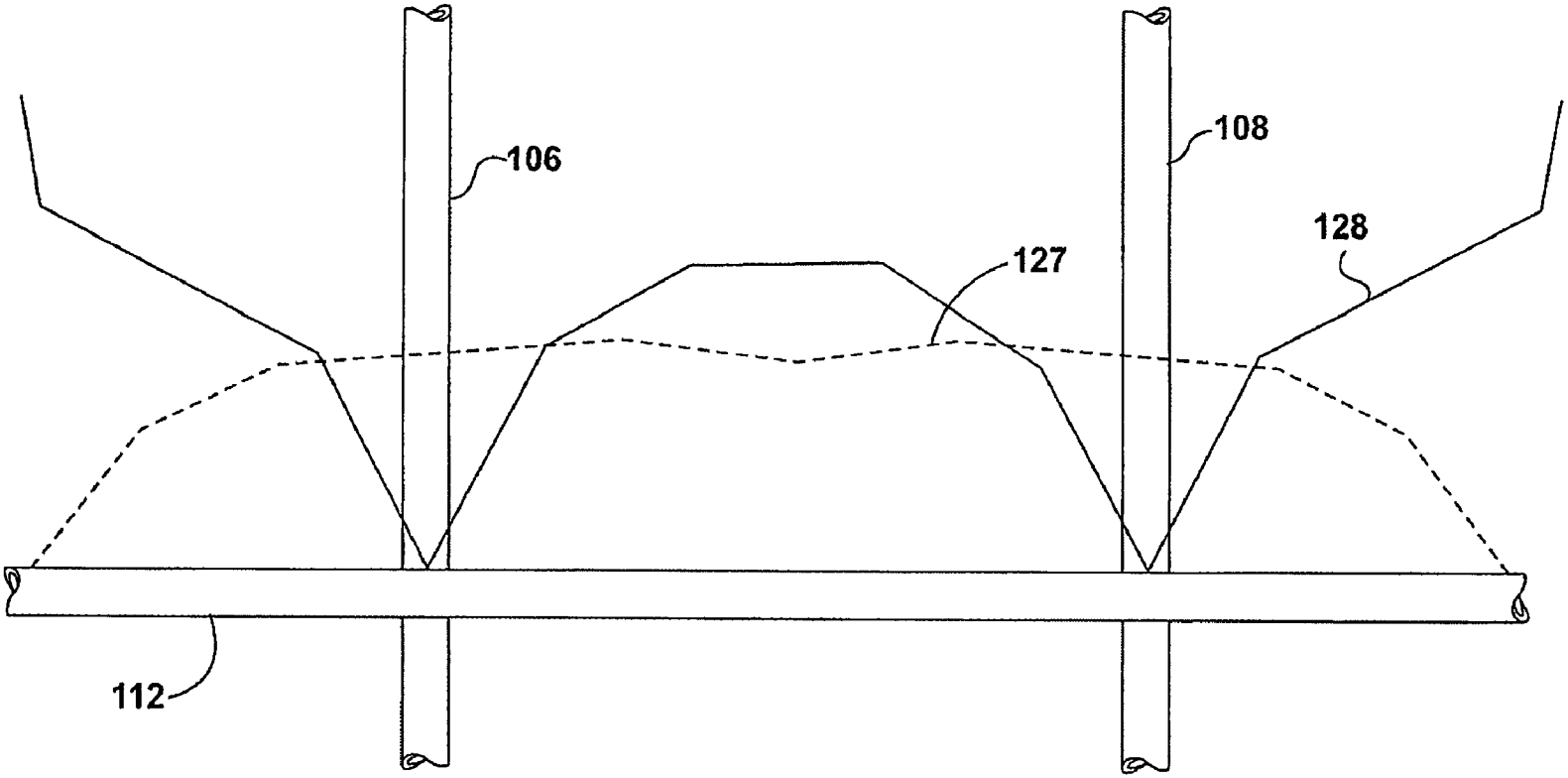
FIG. 9 is a schematic side view of an array of horizontal and vertical wells for use with embodiments of the present invention.
Figure 10:
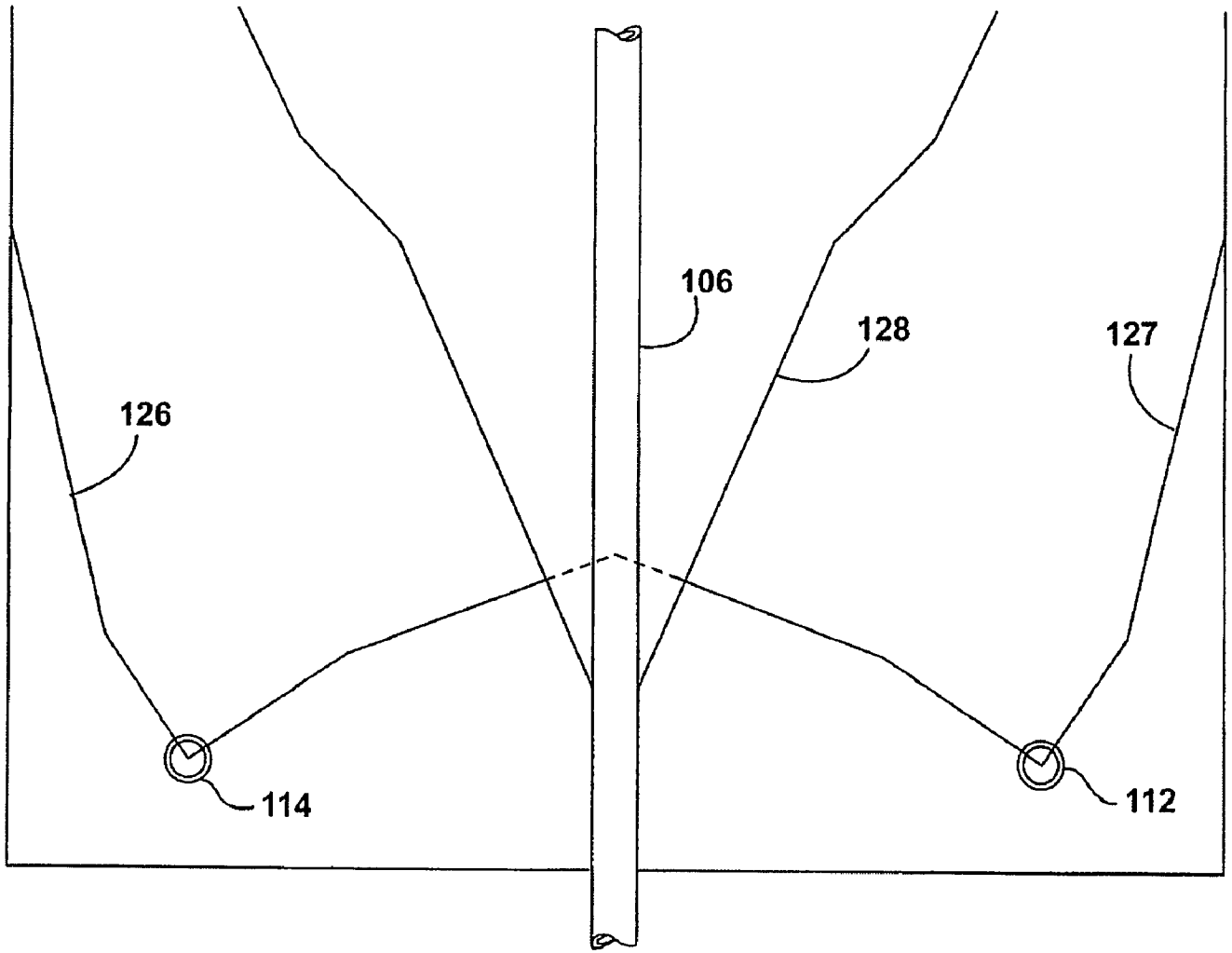
FIG. 10 is a schematic end view of an array of horizontal and vertical wells for use with embodiments of the present invention.

FIGS. 9 and 10 provide cross-sectional views of the configuration or geometry of the solvent fluid chambers 127 and 128. It will be understood that a cross-sectional view of fluid chamber 126 and 128 would be the same as seen in FIG. 9; therefore only the solvent fluid chamber at 127 and 128 will be described. As seen in FIG. 9, elongated solvent fluid chambers in fluid connection are formed at each of vertical wells 106 and 108. While it will be understood that the specific configuration or geometry of solvent fluid chamber 128 will be dictated by reservoir conditions, it is seen in FIG. 9 as two generally conical shaped solvent fluid chambers as described above. As noted above, solvent fluid chamber 127 is generally fusiformed or spindle shaped along the horizontal axis of well 112. As seen in FIG. 10, two angled or diagonal solvent fluid chambers in fluid connection are formed at each of horizontal wells 112 and 114.

It will be understood that some or all these steps can then be repeated if, for example, (a) the solvent chamber configuration or geometry is not achieved or is lost (e.g. converts to a gravity overriding solvent chamber) due to equipment failure or process stoppage for any reason and the solvent fluid chamber needs to be re-created; or (b) the configuration, geometry or size of the solvent fluid chamber need to be optimized (e.g. create more solvent fluid chamber along the horizontal well, creating more of a solvent fluid chamber between the vertical wells or changing the composition of the solvent).

Eventually, continuous solvent fluid injection into vertical wells 106 and 108 and continuous production from horizontal wells 112 and 114 can occur until deposit or reservoir 90 has had a significant portion, such as 20-80%, of the heavy oil extracted. Likewise, injection rates into the vertical wells can be adjusted to maximize the recovery of heavy oil and bitumen. It will be understood that as the heavy oil is being extracted from the area surrounding vertical wells 106 and 108 as well as horizontal wells 112 and 114, then extracting using the process noted above can concurrently or subsequently be implemented to wells 100 and 102 or others within the area of reservoir 90.

EXAMPLE

Producing Heavy Oil by Creating and Maintaining Diagonal Solvent Chambers Using Horizontal Wells

| Step | Rate | Pressure | Duration | Expected Results |
|---|---|---|---|---|
| 1a - Inject solvent into well 52 until significant solvent breakthrough to wells 50 & 51 | Very high rates, possibly exceeding 28,000 standard m3/d | Highest injection pressures in excess of 100 kpa above reservoir pressure | Roughly 1 month | Significant gas channelling occurring from well 52 to 50 and from well 52 to 51 |
| 1b - Simultaneously with step 1a produce reservoir fluids from wells 50 & 51 and solvent as it channels from well 52 | Very high rates | Highest production drawdown at inflow pressures in excess of 100 kpa below reservoir pressure | Roughly simultaneously with step 1a | Oil production along with significant gas channelling occurring from well 52 to 50 and from well 52 to 51 |
| Step 2a - Inject solvent in wells 50 & 51 until significant solvent production occurs at well 52 | Very high rates, possibly exceeding a total of 28,000 standard m3/d | Highest injection pressures in excess of 100 kpa above reservoir pressure | Roughly 1 month | Significant gas channelling occurring from well 50 to 52 and from well 51 to 52 |
| 2b - Simultaneously with 2a produce reservoir fluids and solvent from well 52 and more solvent as it channels from wells 50 & 51 | Very high rates | Highest production drawdown at inflow pressures in excess of 100 kpa below reservoir pressure | Roughly simultaneously with step 2a | Oil and some solvent production along with significant gas channelling occurring from well 50 to 52 and from well 51 to 52 |
| 3+ - Repeat steps 1a, 1b, 2a and 2b numerous times until wells 50 & 51 produce less oil than well 52 and too much gas | Very high rates | As above | Roughly 1 month for each step | Oil and solvent production with significant gas channelling with diagonal chamber growth in size and along most of the horizontal lengths of each well |
| 4 - Continuously inject solvent into wells 50 & 51 and continuously produce oil and solvent from well 52 | At maximum oil production rate and minimum solvent gas recycling | At drawdown pressures that maximize oil production and minimize gas recycling | Continuously until depletion of the reservoir | Oil production, solvent production |

EXAMPLE

Producing Heavy Oil by Creating and Maintaining Solvent Chambers Using Horizontal Producing Wells & Vertical Injection Wells

| Step | Rate | Pressure | Duration | Expected Results |
|---|---|---|---|---|
| 1a - Inject solvent into vertical (vt.) well 108 until significant solvent breakthrough to vt. well 106 | Very high rates, possibly exceeding 14,000 standard m3/d | Highest injection pressures in excess of 100 kpa above reservoir pressure | Roughly 1 month or until a significant and stable gas channel forms | Significant gas channelling occurring from well 108 to 106 and forming a stable gas channel with high gas saturation |
| 1b - Simultaneously produce reservoir fluids from well 106 and solvent as it channels from well 108 | Very high rates | Highest production drawdown at inflow pressures in excess of 100 kpa below reservoir pressure | Roughly simultaneously with step 1a | Oil production along with significant gas channelling occurring from well 108 to 106 as described above |
| 2 - Inject solvent in wells 108 & 106 while producing reservoir fluid from wells 110 and 104 so as to channel gas towards 110 and 104 | Very high rates, possibly exceeding a total of 28,000 standard m3/d | Highest injection pressures in excess of 100 kpa above reservoir pressure | Roughly 0.5-1 month. Injection time to be more than half the breakthrough time in step 1a | Significant gas channelling occurring from well 108 towards 110 and from well 106 towards 104. inject for a time longer than half the breakthrough time measured in steps 1a and 1b |
| 3 - Inject solvent in horizontal (hz.) wells 112 & 114 while wells 108 and 106 are preferably shut in but these wells could be producing | Very high rates, possibly exceeding a total of 28,000 standard m3/d | Highest injection pressures in excess of 100 kpa above the reservoir pressures at wells 108, 106 and their gas chamber pressure | Roughly 1 month | Significant gas channelling occurring from hz wells 112 and 114 towards the gas chamber around wells 106 and 108 |
| 4a - Produce reservoir fluids and solvent from hz wells 112 and 114 | Very high rates | Highest production drawdown at inflow pressures in excess of 100 kpa below reservoir pressure | Roughly 1 month | Oil and some solvent production |
| 4b - Inject solvent in wells 108 & 106 while producing reservoir fluid from wells 112 and 114 to channel gas toward 112 and 114 and expand the gas chamber around wells 108 & 106 | Very high rates, possibly exceeding a total of 28,000 standard m3/d | Highest injection pressures in excess of 100 kpa above reservoir pressure | Roughly simultaneously with step 4a | Significant gas channelling occurring from the gas chamber around wells 106 and 108 towards the gas chambers around wells 112 and 114 |
| 5+ - Repeat steps 4a and 4b numerous times until the gas chambers around the hz wells 112 and 114 significantly connects with the gas chamber around wells 106 & 108 | Very high rates | As above | Roughly 1 month for each step | Oil and solvent production from 112 and 114 with significant gas channelling with growth of the gas chamber along most of the horizontal lengths of each well and also growth of the gas chamber around wells 108 & 106. |
| 6 - Continuously inject solvent into wells 106 & 108 and continuously produce oil and solvent from hz wells 112 and 114 | At maximum oil production rate and minimum solvent gas recycling | At drawdown pressures that maximize oil production and minimize gas recycling | Continuously until depletion of the reservoir | Oil production, solvent production |

It is understood that while certain forms of this invention have been illustrated and described, it is not limited thereto except insofar as such limitations are included in the following claims and allowable functional equivalents thereof.

We claim:

1. A method for extracting hydrocarbons from a reservoir containing hydrocarbons having an array of wells disposed therein, the method comprising:

(a) continuously injecting a solvent fluid into the reservoir through a first, injection well in the array;

(b) continuously producing reservoir fluid from a second, production well in the array, the production well being offset from the first well, said production being conducted simultaneously with the injection of step (a) to drive the formation of a solvent fluid chamber between the injection well and the production well;

(c) continuing injection of the solvent fluid into the solvent fluid chamber through the injection well to expand the solvent fluid chamber within the reservoir while producing reservoir fluid from the production well; and, (d) upon solvent fluid breakthrough at the second well, switching the continuous injection of the solvent fluid from the first well to the second well whereby the second well becomes the injection well; and, (e) switching the continuous production of the reservoir fluid from the second well to the first well whereby the first well becomes the production well.

2. The method of claim 1 wherein the first and second wells are horizontal wells and the first and second wells are vertically and laterally offset.

3. The method of claim 1 wherein the wells of the array are selected from the group consisting of horizontal wells, vertical wells and combinations thereof.

4. The method of claim 3 wherein the first and second wells are vertical wells.

5. The method of claim 4 further comprising a third well in the array, wherein said third well comprises the production well of step (e).

6. The method of claim 5 wherein the third well is a vertical well.

7. The method of claim 5 wherein the third well is a horizontal well.

8. A method for extracting hydrocarbons from a reservoir containing hydrocarbons, the method comprising:

(a) continuously injecting a solvent fluid into the reservoir through a first well disposed in the reservoir;

(b) continuously producing reservoir fluid from a second well disposed in the reservoir and offset from the first well to create a pressure differential between the first and second well, the pressure differential being sufficient to overcome the gravity force of the solvent fluid so as to drive the formation of a solvent fluid chamber towards the second well, said production being conducted simultaneously with the injection of step (a);

(c) after solvent fluid breakthrough at the second well, switching the functions of the first and second wells whereby solvent fluid is injected into the solvent fluid chamber through the second well to expand the solvent fluid chamber within the reservoir; and (d) reservoir fluid is produced from the first well.

9. The method of claim 8 wherein the solvent fluid chamber is delimited by vertically inclined upper and lower boundaries.

10. The method of claim 9 wherein the upper and lower boundaries converge towards the second well.

11. A method for extracting hydrocarbons from a reservoir containing hydrocarbons, the method comprising:

(a) continuously injecting a solvent fluid into the reservoir through a first well disposed in the deposit;

(b) continuously producing reservoir fluid from a second well disposed in the reservoir and offset from the first well, said production at the second well being conducted simultaneously with the injection at the first well so as to drive the formation of a solvent fluid chamber towards the second well until solvent fluid breakthrough occurs at the second well;

(c) upon solvent fluid breakthrough at the second well, switching the functions of the first and second wells by continuously injecting the solvent fluid into the solvent fluid chamber through the second well; and (d) continuously producing reservoir fluid in the solvent fluid chamber from the first well.

12. The method of claim 11 wherein the first and second wells are horizontal.

13. The method of claim 12 wherein the solvent fluid chamber is delimited by vertically inclined upper and lower boundaries.

14. The method of claim 13 wherein the upper and lower boundaries converge towards the second well.

15. The method of claim 12 wherein the solvent fluid is a liquid, gas or a mixture thereof and the liquid or gas is selected from the group consisting of steam, methane, butane, ethane, propane, pentanes, hexanes, heptanes, and $CO_2$ and mixtures thereof.

16. The method of claim 15 wherein the solvent fluid further comprises a non-condensible gas.

17. The method of claim 16 wherein the hydrocarbons comprise heavy oil and/or bitumen.

18. The method of claim 17 wherein the oil/solvent fluid mixing rate is increased in step (c) by increasing gravity induced counter-flow mixing of the solvent fluid and the hydrocarbons.

19. The method of claim 11 wherein the solvent fluid injection of step (a) or step (c) may be greater than 14,000 standard cubic meters per day.

20. The method of claim 19 wherein a pressure gradient is established between the first and the second wells in step (b) and wherein said gradient is greater than 100 kPa.

21. The method of claim 11 wherein the steps (a) to (d) are repeated at least once.

22. The method of claim 11 wherein the first and second wells are vertically, horizontally or laterally offset.

23. The method of claim 11 wherein the reservoir fluid comprises production oil.

24. A method for extracting hydrocarbons from a reservoir containing hydrocarbons, the method comprising:

(a) injecting a solvent fluid into the reservoir through a first vertical well disposed in the reservoir;

(b) producing reservoir fluid from a second vertical well disposed in the reservoir offset from the first vertical well so as to drive the formation of a first solvent fluid chamber towards the second vertical well until solvent fluid breakthrough occurs at the second vertical well;

(c) injecting the solvent fluid into the reservoir through a first horizontal well disposed in the reservoir and offset from the first and second vertical wells so as to create a second solvent fluid chamber;

(d) producing reservoir fluid from the horizontal well and injecting solvent fluid into the first solvent chamber so as to drive the first solvent fluid chamber towards the second solvent fluid chamber.

25. The method as claimed in claim 24 wherein at least two horizontal wells are disposed in the reservoir and wherein both horizontal wells perform injection or production functions simultaneously.

26. The method as claimed in claim 24 wherein at least two horizontal wells are disposed in the reservoir and wherein at least one first horizontal well functions as an injection well and wherein at least one second horizontal well functions as a production well.

27. The method as claimed in claim 26 wherein said first and second horizontal wells switch functions in order to direct the formation of the second solvent fluid chamber.

28. The method of claim 24 wherein fluid is injected through said horizontal well at a higher pressure than through said first vertical well.

29. method of claim 24 further comprising, after breakthrough at step (b), the step of converting the second vertical well to injection and converting the first vertical well to production until breakthrough of solvent fluid occurs at the first vertical well.

30. A method for extracting hydrocarbons from a reservoir containing hydrocarbons, the method comprising:

(a) continuously injecting a solvent fluid into the reservoir through a first well disposed in the reservoir;

(b) continuously producing reservoir fluid from a second well disposed in the reservoir and offset from the first well, said production at the second well being conducted simultaneously with the injection at the first well to create a direct solvent fluid channel between the first and second well until solvent fluid breakthrough occurs at the second well; and, (c) switching the functions of the first and second wells by continuously injecting solvent fluid into the reservoir from the second well and continuously producing reservoir fluid from the first well to create at least two solvent fluid chambers, each of the solvent fluid chambers having "oil/solvent fluid" mixing and "solvent fluid/oil mixing".

* * * * *